US007839097B2

(12) United States Patent
Chen et al.

(10) Patent No.: US 7,839,097 B2
(45) Date of Patent: Nov. 23, 2010

(54) SYSTEM AND METHOD FOR WIDE-RANGE HIGH-ACCURACY-LOW-DROPOUT CURRENT REGULATION

(75) Inventors: Lu Chen, San Jose, CA (US); Kin Edward Shum, Palo Alto, CA (US)

(73) Assignee: Kinetic Technologies, Sunnyvale, CA (US)

( * ) Notice: Subject to any disclaimer, the term of this patent is extended or adjusted under 35 U.S.C. 154(b) by 144 days.

(21) Appl. No.: 12/012,394

(22) Filed: Jan. 31, 2008

(65) Prior Publication Data

US 2008/0185975 A1 Aug. 7, 2008

Related U.S. Application Data

(60) Provisional application No. 60/899,316, filed on Feb. 3, 2007.

(51) Int. Cl.
*H05B 37/02* (2006.01)

(52) U.S. Cl. ..... 315/291; 315/287; 315/307; 323/274; 323/282

(58) Field of Classification Search ..... 315/209 R, 315/224–225, 287, 291, 296–297, 300, 307; 323/273–277, 280, 282, 316, 351
See application file for complete search history.

(56) References Cited

U.S. PATENT DOCUMENTS

| | | | | |
|---|---|---|---|---|
| 5,025,204 | A * | 6/1991 | Su | 323/274 |
| 6,538,394 | B2 * | 3/2003 | Volk et al. | 315/291 |
| 7,456,586 | B2 * | 11/2008 | Morejon | 315/247 |
| 7,539,538 | B2 * | 5/2009 | Parramon et al. | 607/2 |
| 2006/0022652 | A1 * | 2/2006 | Nishimura et al. | 323/280 |
| 2006/0186827 | A1 * | 8/2006 | Ragonesi et al. | 315/185 S |
| 2006/0202637 | A1 * | 9/2006 | Chiang et al. | 315/291 |
| 2007/0120506 | A1 * | 5/2007 | Grant | 315/312 |
| 2008/0174929 | A1 * | 7/2008 | Shen et al. | 361/103 |

* cited by examiner

*Primary Examiner*—Douglas W Owens
*Assistant Examiner*—Tung X Le
(74) *Attorney, Agent, or Firm*—Dahyee Law Group; Leon E. Jew

(57) ABSTRACT

The invention teaches a semiconductor circuit for driving an LED in which the current passing through the LED is regulated by adjusting the NMOS Rdson using a series of digital signals. The circuit maintains a high current accuracy over wide range of current changes while keeping a low voltage drop.

3 Claims, 4 Drawing Sheets

SYSTEM AND METHOD FOR WIDE-RANGE HIGH-ACCURACY-LOW-DROPOUT CURRENT REGULATION

REFERENCE TO RELATED APPLICATION

The present application claims priority to the provisional Appl. Ser. No. 60/899,316 filed on Feb. 2, 2007, the entire content of which is hereby incorporated by reference.

FIELD OF THE INVENTION

The present invention relates generally to semiconductor integrated circuits (IC) and the like. In particular, the invention relates to a unique LED driving circuit which maintains a high current accuracy over wide range of current changes while keeping a low voltage drop.

BACKGROUND OF THE INVENTION

In today's electronics designs, power control includes voltage or current regulation. One very popular example that requires constant current control is the light emitting diode (LED) application. As a lighting source, the LED unit is required to work with wide range brightness, which is proportional with the forward current passing through the LED unit. Therefore, the LED current needs to be tightly regulated throughout a wide range of current changes.

However, while it is relatively easy to meet accuracy requirement at full current, it is challenging to achieve high accuracy at a low current without a large voltage drop in the current control device connected in series with the LED. In certain applications such as the 1-cell Li ion powered devices, the driving voltage, which is at the battery voltage, can be dropped to merely 100 mV above the backlighting LED voltage, leaving very low voltage "headroom" for the constant current control. This makes it difficult to directly drive the LED without stepping up the input voltage.

The predominant solution today to drive LED backlight with 1-cell Li ion is to step up the input voltage to ensure enough voltage headroom for the current control circuitry. There are two types of current control topologies, current source and current sink, depending on the location of the current regulation circuitry. "Current source" refers to high side current control while "current sink" refers to low side current control. In this document, current sink is used as an example for circuit comparison and implementation of proposed circuit. Similar concept can apply to current source topology as well.

FIG. 1 is a schematic diagram illustrating a typical current sink circuit used to control white LED current according to the prior art. The circuit is coupled between a voltage source represented by node 11 and node 12. The current source 13 and resistor 15 are coupled in series. The input terminal 17 of a non-inverting operational amplifier (NOA) 16 is coupled to the node 14 between the current source 13 and the resistor 15. The output terminal 19 of the NOA 16 is coupled to the gate terminal 20A of a field effect transistor (FET) 20. A light emitting diode (LED) 21 is coupled between the node 11 and the drain terminal 20B of the FET 20. A resistor 24 is coupled between the node 12 and the source terminal 20C of the FET 20. The feedback terminal 18 of the NOA 16 is coupled to the node 23. By adjusting the current source (I_ADJ) 13, the non-inverting input voltage (Vref1) of the NOA 16, i.e., the voltage at node 14, varies as a function of resistor (R1) 15. As the equation (1) indicated, once the circuit reaches a steady state, the voltage level of the non-inverting input (Vref1), i.e.

the voltage at the node 14, and the inverting input (V_R2) of the NOA 16, i.e. the voltage at node 23, are very close:

$$Vref1 = V_R2 + Vos, \quad (1)$$

Wherein, Vos is the offset voltage of the NOA 16. Since V_R2 is directly proportional with the LED current, the LED current can be controlled and regulated by adjusting I_ADJ, as indicated in the equation (2):

$$I_ADJ*R1 = I_LED*R2 + Vos, \quad (2)$$

The main drawback of this circuit is that when LED current is low, the voltage level of V_R2 and Vref1 are small. However, Vos for the NOA 16 remains constant and represents a much larger percentage error in a low LED current case, which causes big inaccuracy on the LED current. Therefore, this circuit is not suitable for wide range and high-accuracy requirement.

What is desired is a circuit to maintain high current accuracy over wide range of current while keeping the voltage "headroom" very low.

SUMMARY OF THE INVENTION

In accordance of the present invention, the circuit for driving one or more light emitting diode (LED) devices comprises a first and a second nodes which are adapted to be electrically coupled to a source of voltage, a constant current source and a first resistance means coupled in series between the first node and the second node, a third node coupled between the constant current source and the first resistance means, one or more driving units coupled together in parallel. Each of the driving units comprises a noninverting operational amplifier (NOA) with its input terminal electrically coupled to the third node, a first field effect transistor (FET) with its gate terminal coupled to the NOA's output terminal, an LED coupled between the first node and a drain terminal of the first FET, a current sense resistance means coupled between a source terminal of the first FET and the second node, and a fourth node between the current sense resistance means and the source terminal of the first FET. The fourth node is coupled to a feedback terminal of the NOA. The NOA's non-inverting input voltage remains constant while the electrical current passing through the LED is regulated by regulating the current sense resistance means.

The present invention also teaches a method for maintaining high current accuracy over wide range of current passing through a light emitting diode (LED) while keeping low voltage drop for a current regulation driving circuit coupled to a voltage source. The driving circuit includes a driving component, an LED, and resistance means coupled together through various nodes. The driving component includes a noninverting operational amplifier (NOA) coupled to a first field effect transistor (FET), the driving component's first terminal being coupled to the NOA's input terminal, the NOA's output terminal being coupled to the first FET's gate terminal, the driving component's second terminal being coupled to the first FET's drain terminal, the driving component's third terminal being coupled both to the NOA's feedback terminal and to the first FET's source terminal. The method includes the steps of:

(a) providing a first current path through a constant current source, a first node, and a first resistance means;

(b) providing a second current path through the LED, a second node, a third node, and a current sense resistance means; and (c) coupling a driving component between the first current path and the second current path by:

coupling the driving component's first terminal to the first node;

coupling the driving component's second terminal to the second node; and coupling the driving component's third terminal to the third node;

(d) adjusting the overall resistance of the current sense resistance means using a number of digital signals such that the electrical current passing through the LED varies while the voltage at the first node remains constant.

In a typical preferred embodiment, the first resistance means can be implemented as an NMOS FET, and the current sense resistance means can be implemented as an array of NMOS FETs electrically coupled together in parallel.

DESCRIPTION OF THE INVENTION

Figure 1:
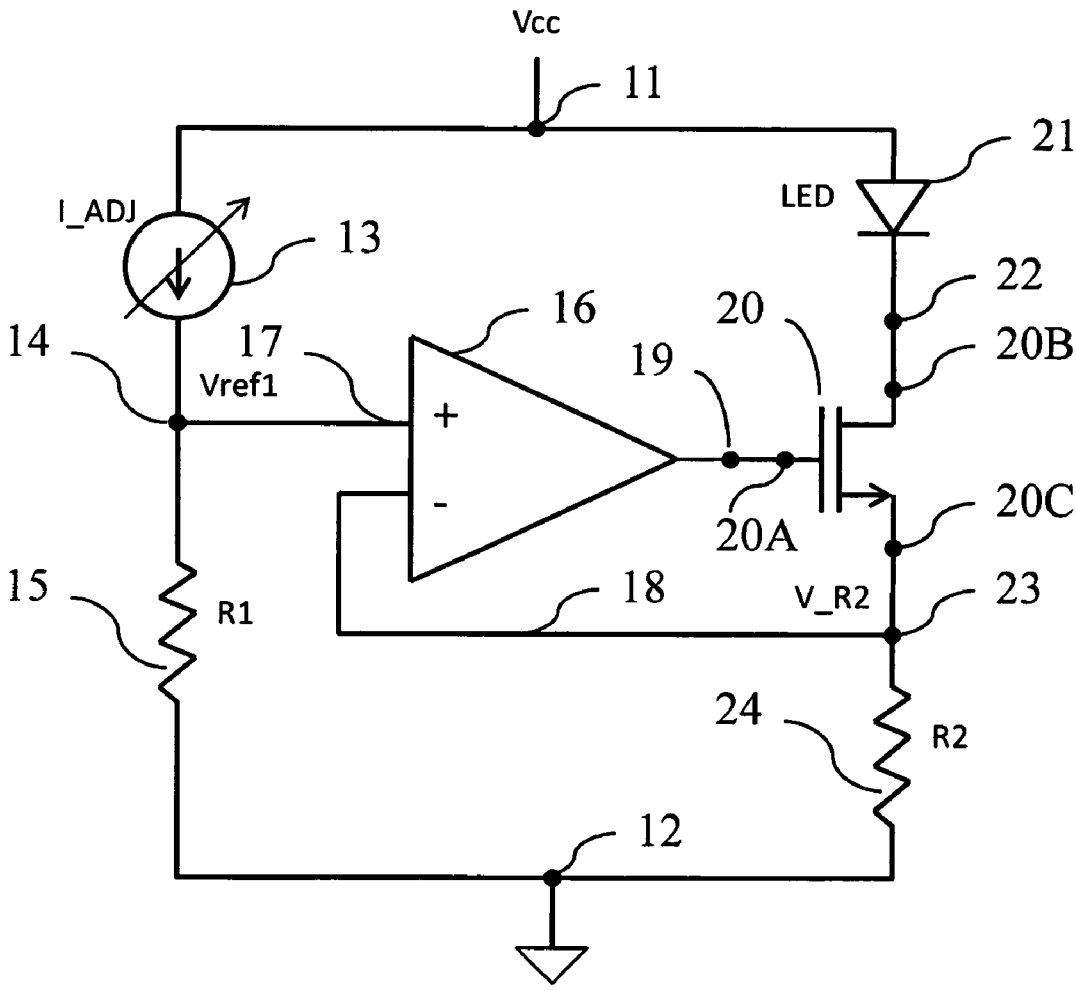
(PRIOR ART) FIG. 1
FIG. 1 is a schematic diagram illustrating a circuit for driving an LED according to the prior art.

While the present invention may be embodied in many different forms, designs or configurations, for the purpose of promoting an understanding of the principles of the invention, reference will be made to the embodiments illustrated in the drawings and specific language will be used to describe the same. It will nevertheless be understood that no limitation of the scope of the invention is thereby intended. Any alterations and further implementations of the principles of the invention as described herein are contemplated as would normally occur to one skilled in the art to which the invention relates.

Figure 2:
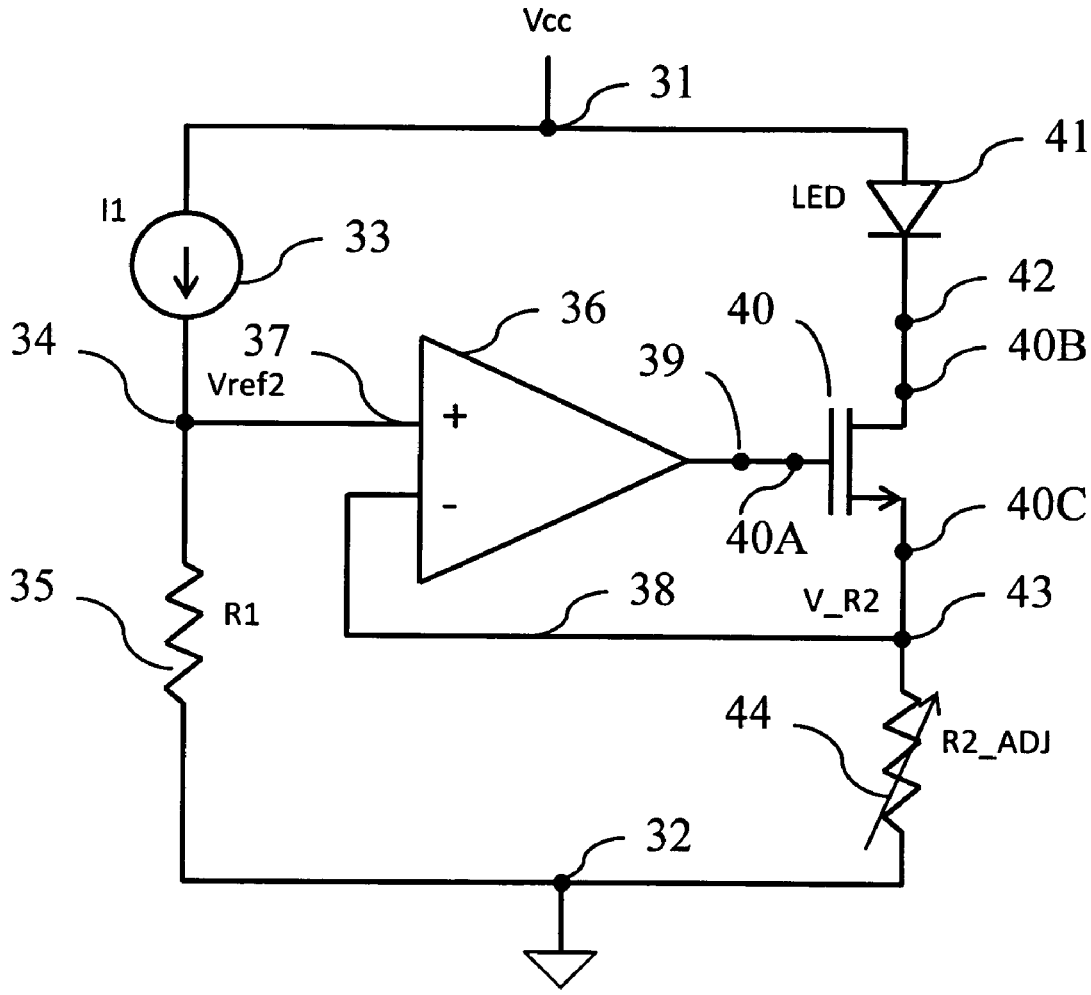
FIG. 2 is a schematic diagram illustrating a circuit for driving an LED according to the present invention.

FIG. 2 is a schematic circuit diagram illustrating a semiconductor circuit according to the typical embodiment of the present invention. The circuit is electrically coupled between a voltage source represented by node 31 and node 32. A constant current source 33 and resistance means 35 are coupled in series between the voltage source represented by node 31 and node 32. The input terminal 37 of a non-inverting operational amplifier (NOA) 36 is electrically coupled to the node 34 between the constant current source 33 and the resistance means 35. The output terminal 39 of the NOA 36 is electrically coupled to the gate terminal 40A of a field effect transistor (FET) 40. A light emitting diode (LED) 41 is coupled between the node 31 and the drain terminal 40B of the FET 40. A current sense resistance means (R2_ADJ) 44 is electrically coupled between the node 32 and the source terminal 40C of the FET 40. The feedback terminal 38 of the NOA 36 is coupled to the node 43. The NOA 36 and the FET 40 constitute a driving component with three terminals represented by the input terminal 37 of the NOA 36, the drain terminal 40B of the FET 40, and the source terminal 40C of the FET 40 respectively, which are electrically coupled to node 34, node 42 and node 43 respectively. In operation, the first current path is through node 31, constant current source 33, node 34, the resistance means 35, and node 32. A second current path is through node 31, LED 41, node 42, FET 40, node 43, the current sense resistance means 44, and node 32. The driving component is electrically coupled between the two current paths.

Instead of adjusting the internal current source, the circuit according to the present invention adjusts the current sense resistor (R2_ADJ) 44. The current source (I1) 33 remains constant at all time, keeping Vref2, i.e. the voltage at node 34, at a fixed level that is close to Vref1 in FIG. 1 in high current case. As such, Vos maintains a small percentage of the input signals, Vref2 and V_R2, regardless of the LED current level. When the LED current is low, Vref2 does not change while R2_ADJ is increased to lower the LED current. Accordingly, Equation (2) can be modified and becomes equation (3):

$$I1*R1=I_LED*R2_ADJ+Vos, \quad (3)$$

This circuit can maintain high accuracy over the wide range of the LED current while keeping low voltage drop for the current sink circuitry. Thus, it can overcome the problems of the prior art. For example, assuming LED VF=3.2V, LED current: 2 mA~20 mA, Vos=4 mV, and the required V_R2 at 20 mA not to exceed 50 mV, if the FIG. 1 method is used, at 20 mA I_LED, V_R2=50 mV, error caused by Vos=4/50=8%, and at 2 mA I_LED, V_R2=5 mV, error caused by Vos=4/5=80%. However, if the FIG. 2 method according to this invention is used, at 2~20 mA, I_LED, V_R 2=50 mV, error caused by Vos=4/50=8%.

Figure 3:
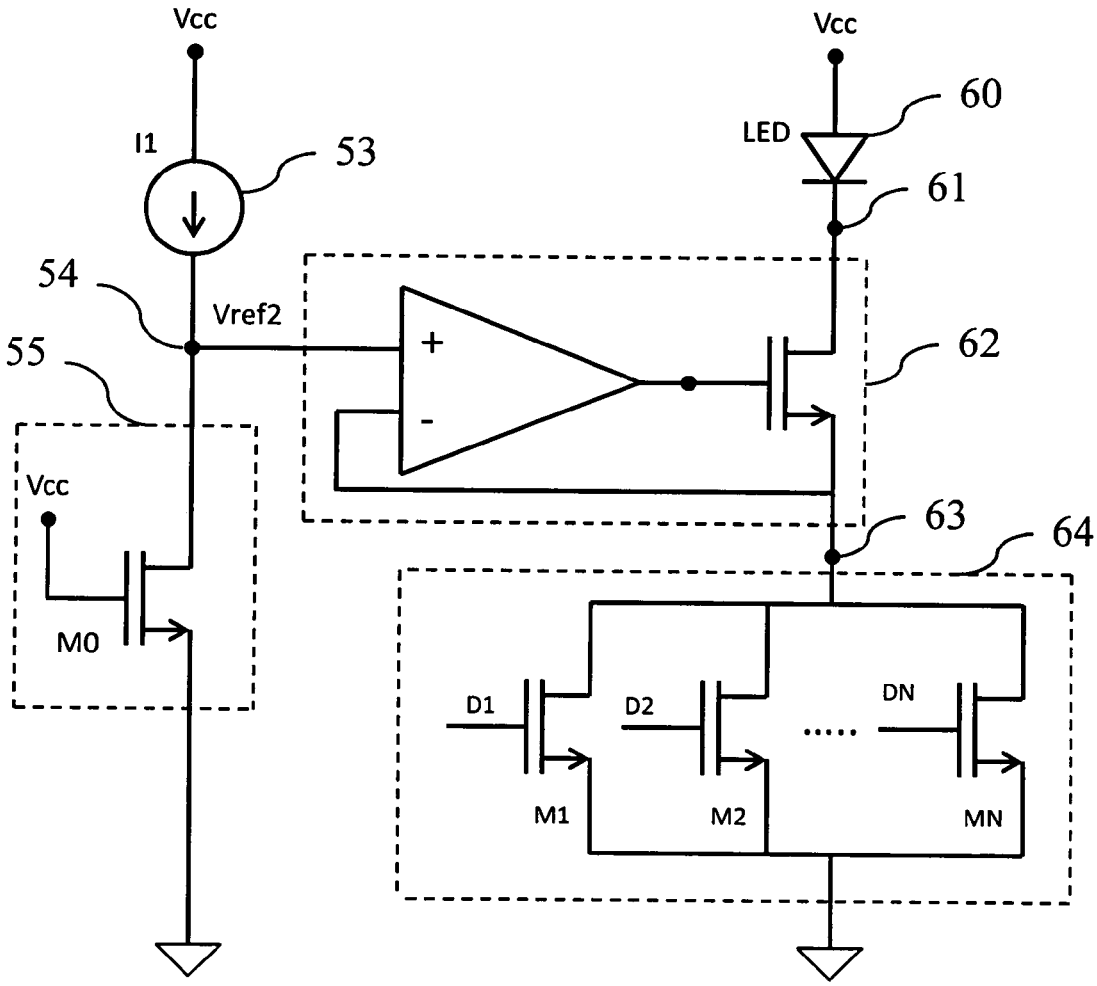
FIG. 3 is a schematic diagram illustrating a circuit for driving an LED according to one preferred embodiment of the present invention.

In the preferred embodiments according to the invention, to have R2_ADJ adjusted easily, the resistance means (R1) 35 in FIG. 2 can be implemented as a negative-channel metal-oxide semiconductor (NMOS) on-resistance (Rdson) 55 as shown in FIG. 3. The current resistance means (R2_ADJ) 44 in FIG. 2 can be implemented as an array (M1, M2, . . . , MN) 64 of NMOS Rdson coupled together in parallel as illustrated in FIG. 3. In operation, the first current path is through the constant current source 53, node 54, and the resistance means 55. A second current path is through the LED 60, node 61, the driving component 62, node 63, and the current sense resistance means 64. The driving component 62 is electrically coupled between the two current paths, with its first terminal coupled to node 54, the second terminal coupled to node 61 and the third terminal coupled to node 63. The NMOS array 64 includes at least two NMOS coupled together in parallel. The gate of the NMOS (M0) 55 is coupled to the voltage supply VCC and it works as a resistor. The gates of the NMOS array 64 are controlled by a series of digital signals D1, D2, . . . , DN respectively. When a digital signal is high, the controlled NMOS works as a resistor. When the digital signal is lower than a threshold, the controlled NMOS is turned off. By changing the digital signals D1, D2, . . . , DN, the overall resistance of the NMOS array 64 is adjusted, and the LED current is automatically changed accordingly.

Figure 4:
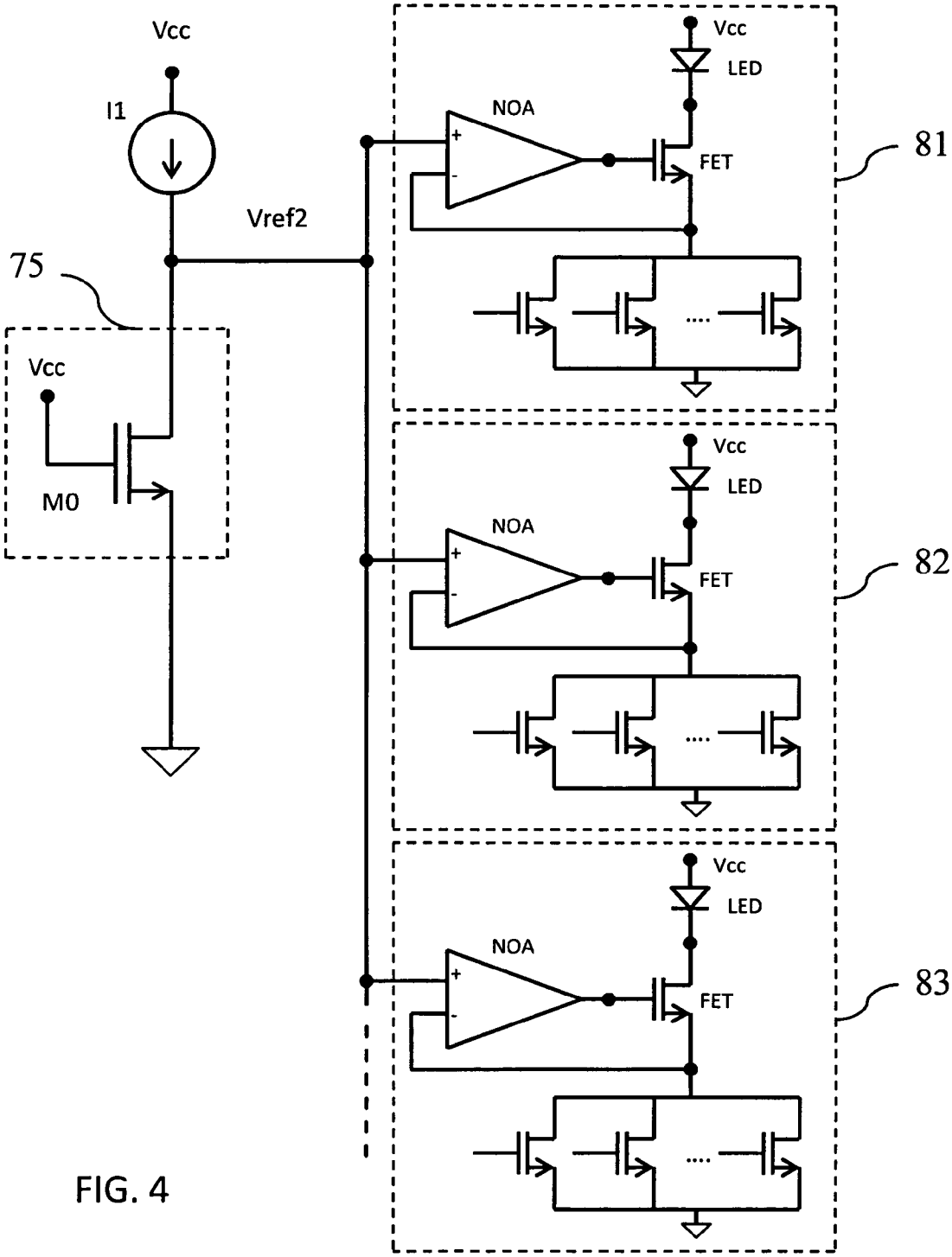
FIG. 4 is a schematic diagram illustrating a multiple-channel circuit for driving multiple LEDs according to another preferred embodiment of the present invention.

In another preferred embodiment, to drive multiple LEDs concurrently, a multi-channel current regulation circuit can be implemented in the form as illustrated in FIG. 4. In this embodiment, at least two driving units 81-82 are coupled together in parallel. The configuration of each of the driving units is substantially same as the configuration as illustrated in FIG. 3. The circuit within each dash-line block drives one LED. All the circuits share the same reference voltage Vref2 generated by current source I1 and NMOS (M0) 75.

To maximize the accuracy of operations, the best matching of NMOS FETs in the semiconductor circuit design is most preferred. For example, in the most preferred embodiment, M0 is required to be physically and topologically close to M1, M2, . . . , MN. In addition, the NMOS FETs (M0, M1 . . . MN)

should also be the same type of the devices. In one configuration, the NMOS FETs (M0, M1 . . . MN) are identical or substantially same devices.

While one or more embodiments of the present invention have been illustrated above, the skilled artisan will appreciate that modifications and adoptions to those embodiments may be made without departing from the scope and spirit of the present invention.

The invention claimed is:

1. A circuit comprising:

a first and a second nodes which are adapted to be electrically coupled to a voltage source;

a constant current source electrically coupled to said first node;

a first resistance means electrically coupled in series between said constant current source and said second node;

a third node coupled between said constant current source and said first resistance means; and a current regulation driving unit electrically coupled to said third node, said current regulation driving unit comprising:

a noninverting operational amplifier (NOA) with its input terminal electrically coupled to said third node;

a first field effect transistor (FET) with its gate terminal electrically coupled to said NOA's output terminal;

a light emitting diode (LED) electrically coupled between said first node and said first FET's drain terminal;

a fourth node electrically coupled to said NOA's feedback terminal and said first FET's source terminal; and a current sense resistance means electrically coupled between said fourth node and said second node, said current sense resistance means regulating said LED's electrical current while maintaining said NOA's noninverting input voltage constant;

wherein said first resistance means is a second FET;

wherein said current sense resistance means comprises at least two FETs electrically coupled together in parallel, each of said at least two FETs being controlled by a digital signal;

wherein said second FET is physically close to said at least two FETs; and wherein said second FET and said at least two FETs are substantially same devices.

2. A circuit for driving at least two light emitting diode (LED) devices, comprising:

a first and a second nodes which are adapted to be electrically coupled to a voltage source;

a constant current source having a first terminal electrically coupled to said first node and a second terminal electrically coupled to a first terminal of a first resistance means, a second terminal of said first resistance means being electrically coupled to said second node; and a third node coupled between said constant current source and said first resistance means, said third node being adapted to be electrically coupled to at least two driving units which are electrically coupled together in parallel, wherein each of said driving units comprises:

a noninverting operational amplifier (NOA) with its input terminal electrically coupled to said third node;

a first field effect transistor (FET) with its gate terminal electrically coupled to said NOA's output terminal;

a light emitting diode (LED) electrically coupled between said first node and said first FET's drain terminal;

a fourth node electrically coupled to said NOA's feedback terminal and said first FET's source terminal; and a current sense resistance means electrically coupled between said fourth node and said second node, said current sense resistance means regulating said LED's electrical current while maintaining said NOA's noninverting input voltage constant;

wherein said first resistance means is a second FET;

wherein said current sense resistance means is a third FET controlled by a digital signal;

wherein said current sense resistance means comprises at least two FETs electrically coupled together in parallel, each of said at least two FETs being controlled by a digital signal;

wherein said second FET is physically close to said at least two FETs; and wherein said second FET and said at least two FETs are substantially same devices.

3. A method for maintaining high current accuracy over wide range of current passing through a light emitting diode (LED) while keeping low voltage drop for a current regulation driving circuit coupled to a voltage source, the method comprising the steps of:

(a) providing a first current path through a constant current source, a first node, and a first resistance means;

(b) providing a second current path through said LED, a second node, a third node, and a current sense resistance means; and (c) coupling a driving unit between said first current path and said second current path by:

coupling said driving unit's first terminal to said first node;

coupling said driving unit's second terminal to said second node; and coupling said driving unit's third terminal to said third node; and (d) adjusting said current sense resistance means such that electrical current passing through said LED varies while voltage at said first node remains constant;

wherein said driving unit comprises a noninverting operational amplifier (NOA) coupled to a first field effect transistor (FET), said driving unit's first terminal being coupled to said NOA's input terminal, said NOA's output terminal being coupled to said first FET's gate terminal, said driving unit's second terminal being coupled to said first FET's drain terminal, said driving unit's third terminal being coupled both to said NOA's feedback terminal and to said first FET's source terminal;

wherein said first resistance means is a second FET;

wherein said current sense resistance means is a third FET controlled by a digital signal;

wherein said current sense resistance means comprises at least two FETs electrically coupled together in parallel, each of said at least two FETs being controlled by a digital signal;

wherein said second FET is physically close to said at least two FETs; and wherein said second FET and said at least two FETs are substantially same devices.

* * * * *